US006559430B2

(12) United States Patent
Monforton et al.

(10) Patent No.: US 6,559,430 B2
(45) Date of Patent: May 6, 2003

(54) FOIL EDGE CONTROL FOR MICROWAVE HEATING

(75) Inventors: Randal J. Monforton, Eden Prairie, MN (US); Hong Ji, Woodbury, MN (US); Clifton F. Richardson, Woodbury, MN (US); Achilles D. Speliotopoulos, McLean, VA (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/754,797

(22) Filed: Jan. 4, 2001

(65) Prior Publication Data

US 2002/0121516 A1 Sep. 5, 2002

(51) Int. Cl.[7] ..... H05B 6/80

(52) U.S. Cl. ..... 219/728; 219/729; 219/730; 219/736; 426/234; 426/107; 99/DIG. 14

(58) Field of Search ..... 219/728, 729, 219/730, 759, 736; 426/234, 241, 243, 107; 79/DIG. 14; 216/33, 35, 36, 100, 102, 95

(56) References Cited

U.S. PATENT DOCUMENTS

| | | | | |
|---|---|---|---|---|
| 3,219,460 A | | 11/1965 | Brown | |
| 3,985,991 A | | 10/1976 | Levinson | |
| 4,080,524 A | | 3/1978 | Greenfield, Jr. et al. | |
| 4,081,646 A | | 3/1978 | Goltsos | |
| 4,144,435 A | | 3/1979 | Clark et al. | |
| 4,144,438 A | | 3/1979 | Gelman et al. | |
| 4,190,757 A | | 2/1980 | Turpin et al. | |
| 4,196,331 A | | 4/1980 | Leveckis et al. | |
| 4,204,105 A | | 5/1980 | Leveckis et al. | |
| 4,228,334 A | | 10/1980 | Clark et al. | |
| 4,268,738 A | | 5/1981 | Flautt, Jr. et al. | |
| 4,283,427 A | | 8/1981 | Winters et al. | |
| 4,345,133 A | * | 8/1982 | Cherney et al. | 219/729 |
| 4,656,325 A | | 4/1987 | Keefer | |
| 4,676,857 A | | 6/1987 | Scharr et al. | |
| 4,689,458 A | | 8/1987 | Levendusky et al. | |
| 4,701,585 A | * | 10/1987 | Stewart | 219/730 |
| 4,703,148 A | | 10/1987 | Mikulski et al. | |

(List continued on next page.)

FOREIGN PATENT DOCUMENTS

| | | |
|---|---|---|
| CA | 2098184 | 6/1997 |
| EP | 0047 491 | 5/1998 |
| WO | WO 92/03358 | 3/1992 |
| WO | WO 00/474491 | 8/2000 |

OTHER PUBLICATIONS

Article "You Can Use Metal In A Microwave Oven," Microwave World, vol. 13, No. 1—Summer 1992.

Article "A Microwave Oven Model, Examples of Mcirowave Heating Computations", Microwave World, vol. 19, No. 1—Summer 1998.

*Classical Electrodynamics*, John David Jackson, Second Edition, 1962, 1975; Chapter 8 "Wave Guides and Resonant Cavities", pp. 335–375; Sect. 9.11 "Simple Radiating Systems, Scattering, and Diffraction", pp. 438–441.

*Dieletrics and Waves*, Arthur R. Von Hippel, 1954, "Guided Waves", pp. 67–73.

(List continued on next page.)

*Primary Examiner*—Philip H. Leung
(74) *Attorney, Agent, or Firm*—John M. Haurykiewicz; John A. O'Toole; Douglas J. Taylor

(57) ABSTRACT

A method for controlling heating and avoiding arcing in microwave food packaging having a conductive material such as a metal foil on the packaging by controlling the cross-sectional shape of the foil to have a predetermined shape at the edge portion of the foil including controlling a wedge angle and a corner radius of the edge of the foil.

26 Claims, 6 Drawing Sheets

U.S. PATENT DOCUMENTS

| | | | | |
|---|---|---|---|---|
| 4,734,288 | A | | 3/1988 | Engstrom et al. |
| 4,777,053 | A | | 10/1988 | Tobelmann et al. |
| 4,810,844 | A | | 3/1989 | Anderson |
| 4,865,921 | A | | 9/1989 | Hollenberg et al. |
| 4,866,234 | A | | 9/1989 | Keefer |
| 4,870,233 | A | | 9/1989 | McDonald et al. |
| 4,888,459 | A | | 12/1989 | Keefer |
| 4,908,246 | A | | 3/1990 | Fredricks et al. |
| 4,915,780 | A | | 4/1990 | Beckett |
| 4,927,991 | A | | 5/1990 | Wendt et al. |
| 4,962,000 | A | | 10/1990 | Emslander et al. |
| 4,962,293 | A | * | 10/1990 | Lackey ..... 219/730 |
| 4,970,360 | A | * | 11/1990 | Pescheck et al. ..... 219/730 |
| 4,972,058 | A | | 11/1990 | Benson et al. |
| 4,972,059 | A | | 11/1990 | Wendt et al. |
| 4,973,810 | A | | 11/1990 | Brauner |
| 4,985,606 | A | | 1/1991 | Faller |
| 5,006,684 | A | | 4/1991 | Wendt et al. |
| 5,012,068 | A | | 4/1991 | Anderson |
| 5,038,009 | A | | 8/1991 | Babbitt |
| 5,039,364 | A | | 8/1991 | Beckett et al. |
| 5,059,279 | A | | 10/1991 | Wilson |
| 5,081,330 | A | | 1/1992 | Brandberg et al. |
| 5,117,078 | A | | 5/1992 | Beckett |
| 5,124,519 | A | | 6/1992 | Roy et al. |
| 5,164,562 | A | | 11/1992 | Huffman et al. |
| 5,185,506 | A | | 2/1993 | Walters |
| 5,221,419 | A | | 6/1993 | Beckett |
| 5,254,821 | A | | 10/1993 | Walters |
| 5,256,846 | A | | 10/1993 | Walters |
| 5,260,537 | A | | 11/1993 | Beckett |
| 5,300,746 | A | | 4/1994 | Walters et al. |
| 5,331,135 | A | | 7/1994 | Ovadia |
| 5,354,973 | A | | 10/1994 | Beckett |
| 5,391,430 | A | | 2/1995 | Fabish et al. |
| 5,412,187 | A | | 5/1995 | Walters et al. |
| 5,413,757 | A | | 5/1995 | Kutner et al. |
| 5,468,939 | A | | 11/1995 | MacLean, IV |
| 5,473,142 | A | | 12/1995 | Mass |
| 5,489,766 | A | | 2/1996 | Walters et al. |
| 5,519,195 | A | | 5/1996 | Keefer et al. |
| 5,679,278 | A | | 10/1997 | Cox |
| 5,698,127 | A | | 12/1997 | Lawrence et al. |
| 5,928,555 | A | | 7/1999 | Kim et al. |
| 6,204,492 | B1 | * | 3/2001 | Zeng et al. ..... 219/728 |

OTHER PUBLICATIONS

*Microwave Cooking and Processing*, Charles R. Buffler, PhD, 1993, Chapter 7 "Packaging, Containers, and Susceptors", pp. 84–95.

Article "Historical and Recent Attempts to Solve Microwave Heating Problems with Packaging", vol. 13, No. 1—Summer 1992.

Articles "Better Susceptor Heats Up for Microwave Pizza" and "'Printing' metallized Patterns for Better Control" Packaging Digest, Aug. 1995.

* cited by examiner

FOIL EDGE CONTROL FOR MICROWAVE HEATING

TECHNICAL FIELD

This invention relates to the field of microwave food packaging, and more particularly to the control of heating using a conductive member such as a metal foil in microwave food packaging.

BACKGROUND OF THE INVENTION

Controlled heating of food in microwaves is very important to insure the proper cooking conditions. Such cooking conditions may require uniform heating of food, the avoidance of heating in certain areas or the deliberate heating of food in others. To insure that these various conditions are met, the use of metal foils has been known in microwave food packaging. Use of foil has included promoting even and more intense heating of food and isolating portions of the food from excessive heating. It is also known that use of metal foil in microwave ovens includes the risks of excessive heating or arcing. However, what is not known is the crucial role the profile of the foil edge, and the smoothness of the opening formed by the edge, play in these risks. The present invention advances the art by providing a method for designing the edge geometry to remain within acceptable levels of risk of overheating and arcing.

DETAILED DESCRIPTION OF THE INVENTION

Figure 1:
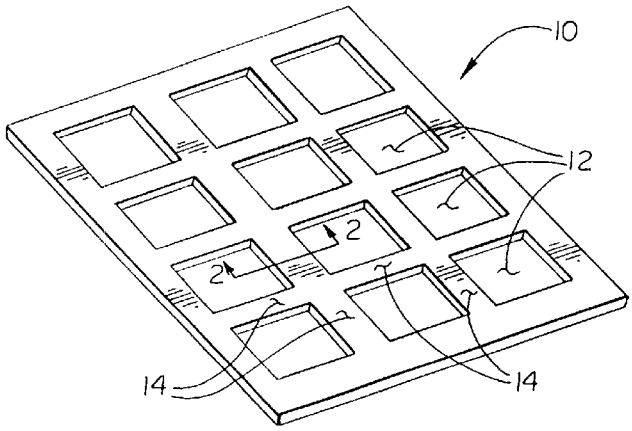
FIG. 1 is a simplified perspective view of a metal foil lattice useful in the packaging of items for microwave heating and cooking.

Referring now to the Figures, and most particularly to FIG. 1, a simplified perspective view of a flat lattice layer 10 may be seen. Layer 10 is preferably formed as a lamination layer of an electrically conductive material such as metal on a microwave transparent substrate, and is typically used to partially or entirely shield an item from microwave irradiation. Layer 10 preferably has a plurality of apertures 12 formed therein. Apertures 12 are formed by intersecting strips 14. When the lattice is formed, it is desirable to control the heating and (most usually) avoid arcing at the edges of the strips making up the latticework 10. It has been found convenient to use a "macroscopic" model of a portion of a strip 14 in analyzing or predicting heating and arcing performance of the lattice 10

Figure 2:
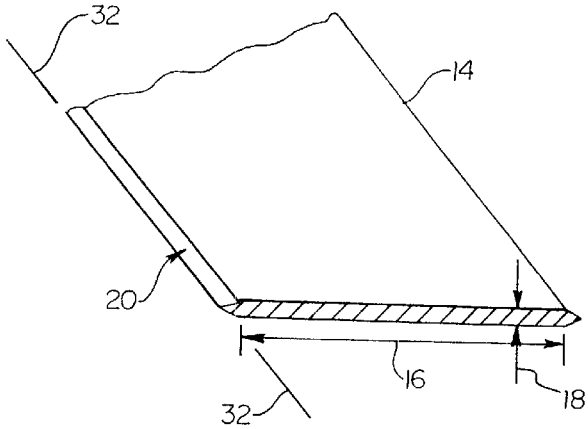
FIG. 2 shows a simplified perspective view of a fragmentary strip of the metal foil member of FIG. 1 taken along line 2—2 of FIG. 1 including a cross section useful in illustrating certain aspects of the present invention.
Figure 3:
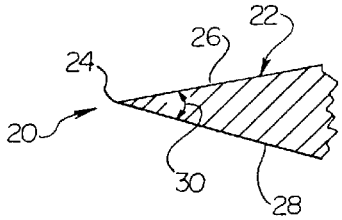
FIG. 3 is an enlarged, fragmentary section view of a portion of an edge of the foil strip model of FIG. 2.

FIG. 2 shows a fragment of the metal layer of FIG. 1 as a long, flat metal foil strip 14 with conductivity σ, width w 16 and thickness b 18. The foil strip 10 shown in FIG. 2 is to be understood as a simplified model of a portion of a foil member such as that shown (but not necessarily limited to) FIG. 1 used in microwave packaging to enable or modify heating or cooking food or heating other items in a microwave oven or applicator. A more detailed model of an edge portion 20 (in cross section) of a profile for the foil element of FIG. 2 is shown in FIG. 3. The profile of the foil in FIG. 3 is modeled as a wedge 22 with a sharp apex or corner 24 formed by intersecting sides 26 and 28 at angle θ identified by reference numeral 30. Practical values for the angle θ range between zero and ninety degrees. As may be seen most clearly in FIG. 2, the line formed by apex of angle θ (the "edge" of the wedge 22) lies along an axis 32. It is to be understood that the conductive member 10 is preferably attached to a non-electrically conductive substrate, shown and discussed in more detail, infra.

The present invention accomplishes its purposes by controlling one or more geometric characteristics of the edge portion of the conductive member. When an E field component of the microwave energy exists parallel to the axis 32 of the wedge 22, arcing can occur if the field strength is sufficient to overcome the dielectric breakdown strength of the material or media adjacent the wedge 22, or more precisely, the media adjacent apex 24). If more than one material is adjacent the apex or tip region of the wedge, the material with the lower dielectric breakdown strength will control and will be the material investigated, because that is where breakdown will first occur.

Figure 4:
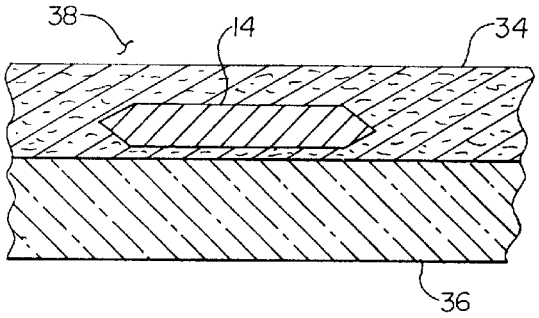
FIG. 4 is a section view of a metal and paper food package resting on a glass layer, as would be typical in a microwave oven, to illustrate further aspects of the present invention.

Referring now to FIG. 4 the foil strip 14 is laminated to a paper food container 34, which in turn is in contact with a glass shelf 36 of a microwave oven (not shown), with a surrounding region of air 38. As shown, the breakdown voltage for the material of the container 34, typically paper or a paper-like product, will control. It is to be understood that the air 38 will not play a role as long as the paper or (other material of the package) remains intact.

When an H field component of the microwave energy exists parallel to axis 32 of the apex 24 of wedge 22, ohmic heating of the conductive material of the wedge 22 is induced. The power P per unit area dissipated through the finite conductivity of the foil at any point is:

$$dP/da=(\omega\delta/16\pi)|H_{||}|^2 \quad (1)$$

where $\omega$ is the radian frequency of the incoming microwave energy, $\delta$ is the skin depth of the metal foil (wedge) and $H_{||}$ is the magnetic field component of the microwave energy parallel to the surface of the foil in the long dimension, parallel to axis 24.

The microwave energy is dissipated through the heating of the metal foil, which in use is ordinarily in contact with the material of container 34, typically paper. The glass 36 and air 38 are typically in contact with the paper, but not the metal of strips 14, as illustrated in FIG. 4. The rise in temperature is determined by the heat equation $$(\partial^2T/\partial x^2)+(\partial^2T/\partial y^2)+(1/k)[(dP/da)]=(1/D)(\partial T/\partial t) \quad (2)$$

where T is the temperature at any point, k is the thermal conductivity, D is the thermal diffusivity of the material under consideration at a location (x,y), with $$q=\alpha(T-T_0), \text{ and } q=\gamma(T-T_0) \quad (3,4)$$

being the equations representing heat flow out of the top and bottom of the model shown in FIG. 4 with $\alpha$ and $\gamma$ being the heat transfer coefficients of the various layers, and $T_0$ being the starting (initial ambient) temperature.

The amount Df heating is determined by $H_{||}$ which, near the apex or edge, has the form $$H_{||}\sim x^{(\theta-\pi)/(2\pi-\theta)} \quad (5)$$

Figure 5:
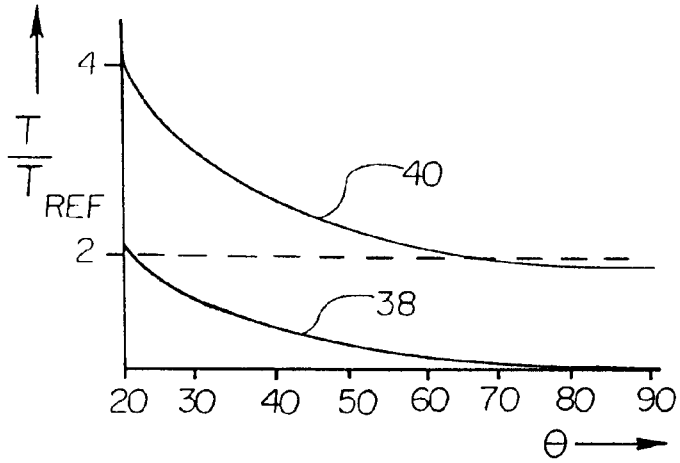
FIG. 5 is a graph of the temperature rise in the metal strip of FIG. 4 as a function of an angle θ forming the edge of the foil as shown in FIG. 3.

Using the energy density of microwave radiation in a typical oven as input, the dependence of the maximum temperature of the metal strip as a function of $\theta$ is shown in FIG. 5. The relevant heat transfer coefficients $\alpha$ and $\gamma$ were determined as follows. The value for $\alpha$ was determined using empirical correlations from the textbook *Heat Transfer* by B. Gebhart, Second Edition, 1971, McGraw Hill, Inc. The $\alpha$ values were confirmed with experiments on single strips. The value for $\gamma$ was determined from the known thermal conductivity and heat capacity of glass. The parameter $\xi$=(tortuous length of edge)/(length of straight line) measures the roughness of the edge of the foil. In FIG. 5, it is to be understood that $T_{ref}$ is the ratio of $T(\theta, \xi)/T(90,1)$ (i.e., the temperature as a function of $\theta$ and $\xi$ divided by the temperature where $\theta$=90° and $\xi$=1). Curve 38 is for $\xi$=1 and curve 40 is for $\xi$=2.

Notice that at $\theta$90°, the heating is at its minimum and it increases as the angle $\theta$ decreases. Moreover, as expected, the temperature rise is greater for rougher edges as there is more material causing the heating. The leading order effect is the fact that the edge is longer with a rougher edge. The electromagnetic field will be altered by the shape, as well, but this is a secondary effect. Thus, by controlling the roughness and edge profile through the manufacturing process, we can control the amount of ohmic heating and thereby control the degree of heating of the food by the metal foil. This may also offer an alternative to using a susceptor as a heating element.

In a situation where it is desired to bring a relatively small load to a given temperature $T_c$, FIG. 5 indicates that a relatively large value for $\theta$ be chosen, to avoid overheating. For purposes of illustration, $\theta$ is set to 90° to minimize the heating attributable to the angle "form factor."

Figure 6:
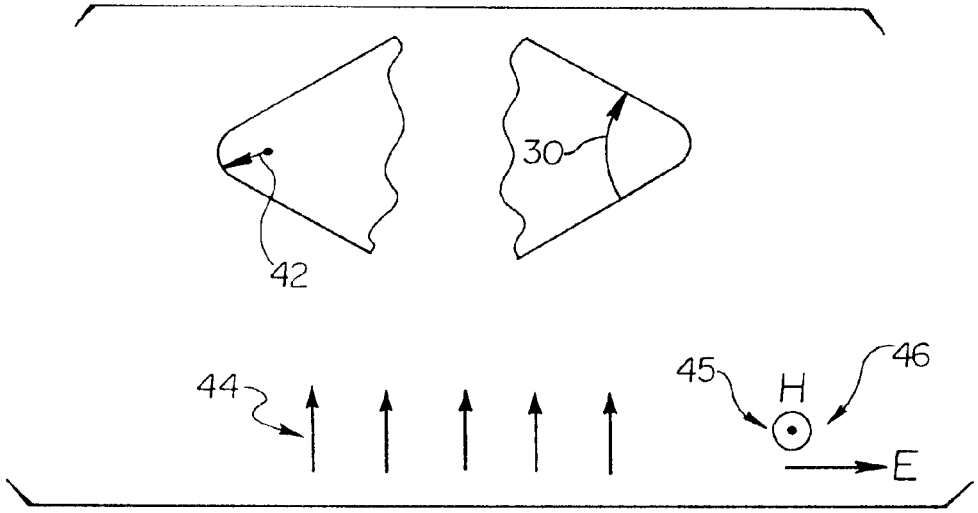
FIG. 6 is a simplified fragmentary cross-section view of foil with an incident microwave field illustrating further aspects of the present invention.

As mentioned above, the E field component of the microwave energy surrounding the foil may induce arcing of the metal foil. Arcing occurs when the local electric field at the surface of a metal exceeds the dielectric breakdown strength of the material or media surrounding it. To determine the governing factors determining arcing, we consider a metal foil with cross-sectional edge portion characteristics shown in FIG. 6. Arrow 42 indicates the radius $r_c$ of the edge portion, while arrow 30 represents the included angle $\theta$ Unlike ohmic heating, the sharpness of the edge $r_c$ plays a critical role. Solving Maxwells' equations numerically, we find that the maximum electric field on the surface of the metal is approximately $$E_{max}=E_0(0.584+0.329\ \theta)(2\pi r_c/\lambda)^{(\theta-\pi)/(2\pi-\theta)} \quad (6)$$

for a typical microwave oven where $\lambda$ is the wavelength of the incident microwave energy, where $E_0$ is the electric field strength relatively far away from the metal foil. Arrows 44 indicate the direction of propagation of the electromagnetic wave, with an H field component directed into the page as indicated by symbol 45, while arrow diagram 46 relates the E field component to the H field component of the ambient microwave energy.

Figure 7:
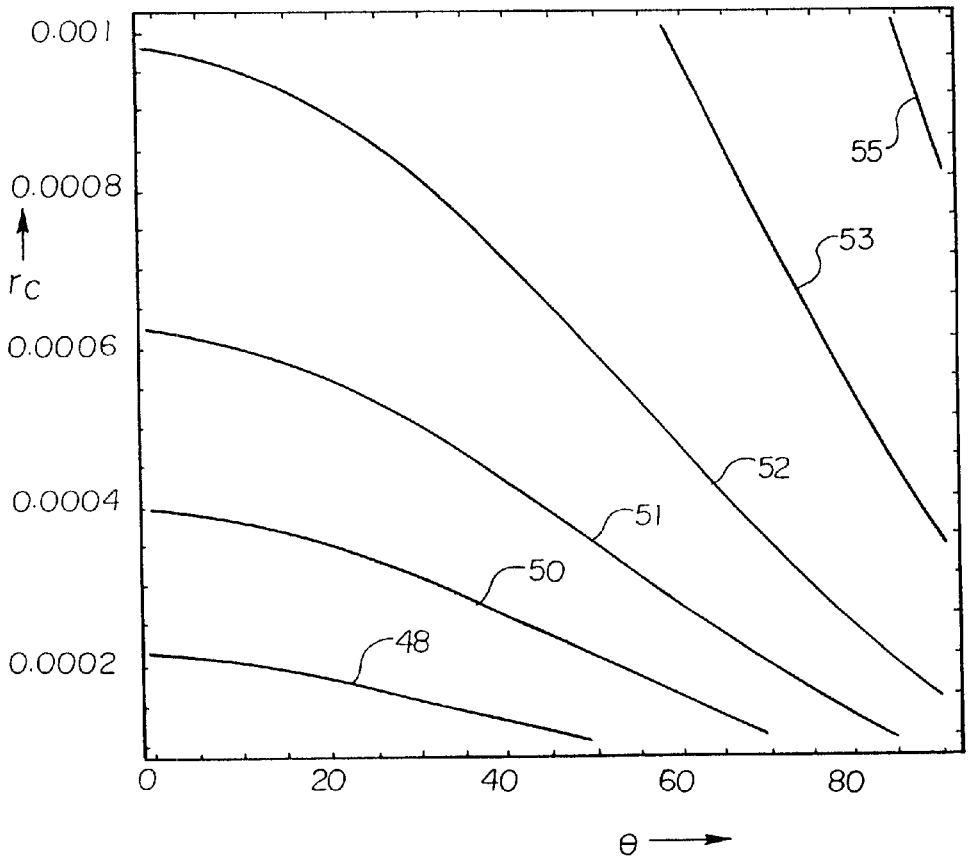
FIG. 7 is graph of constant values of $E_{max}$ as a parameter with a radius $r_c$ on the ordinate and θ on the abscissa.

As presented in the set of curves in FIG. 7, there is a regime of $r_c$ and $\theta$ to avoid in order to prevent incidents of arcing. This technique can be used as a guideline to manufacturing the metal foil used in microwave food packaging. In FIG. 7 the radius $r_c$ (in centimeters) is plotted against the ordinate, while the included angle $\theta$ (in degrees) is plotted against the abscissa, for constant values of $E_{max}$. It is to be understood that there is a critical value $E_{crit}$ for $E_{max}$ above which breakdown will occur, with the value for $E_{crit}$ for the particular medium of interest available from conventional handbooks. The curves shown in FIG. 7 are for constant E contours, and curve 51 is for $E_{crit}$ in air. The area above curve 51 represents combinations of $r_c$ and $\theta$ for which breakdown will not occur. Of course, it may be found preferable to include a margin or offset from $E_{crit}$ to distance a given design from breakdown. Table 1 lists the values of $E_{max}$ for the curves of FIG. 7.

TABLE 1

| Curve | 48 | 50 | 51 | 52 | 53 | 55 |
|---|---|---|---|---|---|---|
| $E_{max}$ ($\times10^6$ V/m) | 1.7 | 1.25 | 1.0 | 0.8 | 0.6 | 0.45 |

In order to design a food package according to the present invention, one must first determine the heating needs of the application in view of the load to be heated. For example, to heat a large load to cooking temperatures, a particular pattern of metal foil is selected, and FIG. 5 is used as a guide to determine the angle $\theta$ and a value for the "roughness" factor $\xi$ for those parts of the metal foil that will be used to heat the load. In the practice of the present invention a value for $\theta$ may chosen, and then FIG. 7 may be consulted. It is to be understood that the contour lines of FIG. 7 are independent of material, except that the contour line or parametric curve 51 corresponds to the critical value $E_{crit}$ for air. A minimum radius $r_c$ will then be able to be read off the $E_{crit}$ curve of that graph to avoid arcing. In addition, a suitable margin or offset may also be included by using a radius greater than the minimum radius indicated by the graph intercept.

In a situation where the foil is carried on a paper substrate in an air environment, one example is to select $\theta$=20° and then consult FIG. 7 which indicates $E_{crit}=10^6$V/m and the minimum $r_c=5.5\times10^{-4}$ cm for $\theta$=20°. While any radius $>r_c$ is acceptable, a somewhat larger radius may be selected to account for manufacturing and operating tolerances.

The dielectric breakdown voltage $E_{crit}$ is determined for each of the media in contact with the foil. Where data is out of range of FIG. 7, Equation (6) may be solved for $r_c$. For example, in analyzing paper as the medium in contact with the foil, Equation (6) may be solved for $r_c$ with $\theta=90°$, $E_0=3\times10^4$ V/m, and $E_{crit}=1\times10^7$ V/m, giving a minimum $r_c=7\times10^{-8}$ cm. Since this value for $r_c$ is orders of magnitude below that which will be physically obtained in practical packaging, $r_c$ will not be controlled by the breakdown of paper, i.e., the minimum $r_c$ will not even be approached by practical physical packaging. Since the value of $r_c$ must be selected to be greater than $5.5\times10^{-4}$ cm for air in the example under consideration, the value of $r_c$ is controlled by the air in contact with the foil, not the paper.

Figure 8:
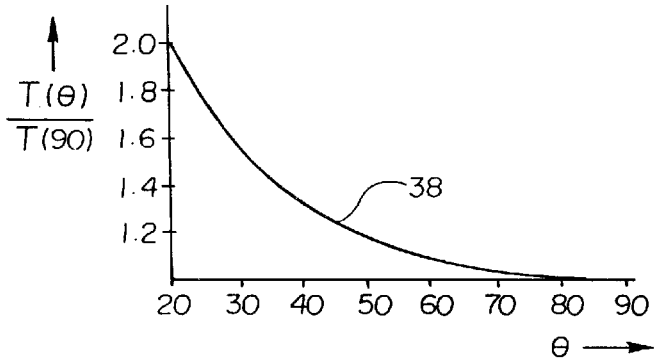
FIG. 8 is a graph of relative temperature rise in a metal strip as a function of angle θ measured with respect to the temperature rise for θ=90°.

FIG. 8 illustrates the effect of wedge angle on heating relative to a normalization value for $\theta=90°$. This figure includes the same information as the lower curve in FIG. 5, except on a larger scale, to enable more precise determination of the relative heating effect a change in $\theta$ will have, when all other variables are held constant.

Figure 9:
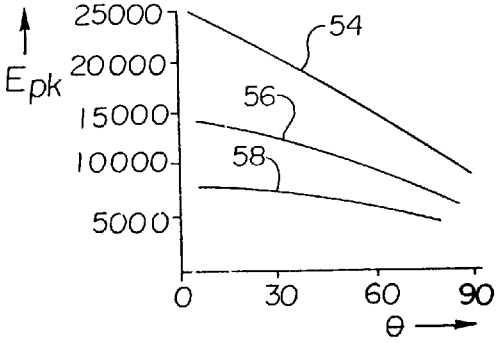
FIG. 9 is a graph of Peak E-field in volts/cm plotted against θ with three different values for $r_c$ shown as a parameter.
Figure 10:
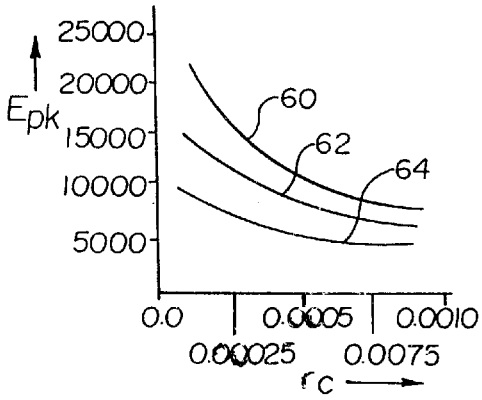
FIG. 10 is a graph of Peak E-field similar to that of FIG. 9, except plotted against $r_c$ with three different values of θ shown as a parameter.

FIGS. 7, 9 and 10 illustrate the relationships between $\theta$ (in degrees), $r_c$ (in cm), and electric field strength (in V/cm), with each graph presenting the same information in a different way, with each of these variables shown as a parameter in one of the graphs, with the other two variable plotted along the axes.

For FIG. 9, curve 54 is for $r_c=0.0001$ cm, curve 56 is for $r_c=0.0003$ cm, and curve 58 is for $r_c=0.001$ cm.

For FIG. 10, curve 60 is for $\theta=20°$, curve 62 is for $\theta=60°$, and curve 64 is for $\theta=90°$.

Figure 11:
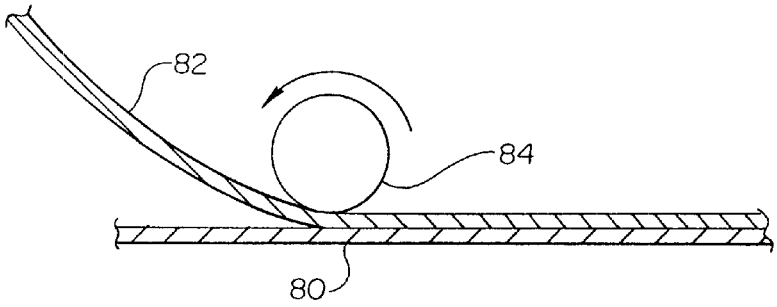
FIG. 11 is a simplified side section view of a foil laminating process useful in the practice of the present invention.

One method to manufacture a package according to the present invention is as follows. First, a base material or substrate 80 is selected. Typical materials are cellulosic materials such as paper or paperboard, or a polymer such as polyethylene terephthalate (PET). Next, a metallic material preferably in the form of a foil 82 is laminated to the substrate 80, one method of which is illustrated in FIG. 11. Example metallic materials are aluminum, steel, or brass, with aluminum preferred for cost. Other conductive materials, such as conductive inks or pastes may also be used. The thickness of the conductive lamina 82 depends on the particular application. An example range of thicknesses that are believed to be appropriate for the practice of the present invention is between about 7 and about 25 $\mu$m. Any suitable conventional means of affixing the conductive and substrate laminae together as is well known is appropriate for this step of the present invention. For example, a pressure roller 84 may be used to bond layers 80 and 82 together using a suitable conventional adhesive (not shown). As used herein, it is to be understood that the terms "foil member" and "foil layer" include conductive materials, whether formed of metal or other substances.

Figure 12:
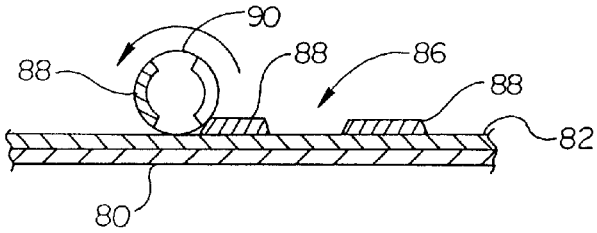
FIG. 12 is a simplified side section view of a resist printing process useful in the practice of the present invention.
Figure 13:
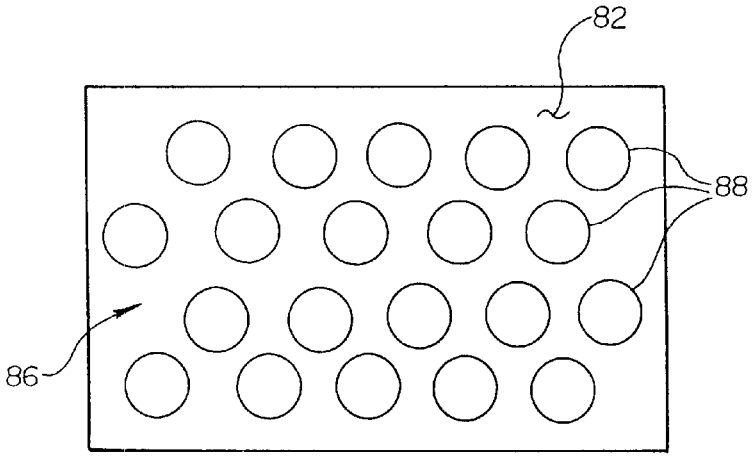
FIG. 13 is a top plan view of an example pattern of the resist of FIG. 12 to be etched into the foil layer of the laminate of FIG. 11.

A two dimensional pattern 86 desired in the conductive layer is then desirably printed on the conductive layer, one form of which is illustrated in FIGS. 12 and 13. Material used in this step is preferably a lacquer or other printable or silk-screenable material 88 that is resistant to chemical etching, as is well known in the art, and is generally referred to as a "resist." As shown in FIG. 12, the resist material 88 is applied to an embossed printing roller 90 by conventional means (not shown) before being transferred by the printing roller 90 to the foil 82 Alternatively, a photo or optical process can be used to treat a photo-sensitive coating material to arrive at the desired pattern, one example of which is shown in FIG. 13. Next, the laminate is subjected to a chemical etching process to remove the conductive material where it is not protected by the resist. Suitable materials for the chemical etching process are well known in the etching industry. The resist may be removed or left in place, if compatible with the microwave and chemical and sanitary requirements of the application.

It is to be understood that FIG. 12 shows the step of printing the resist 88 on the conductive top lamina 82 in a sectioned elevation view. FIG. 13 is a plan view of the laminate made of layers 80 and 82 with the resist pattern 86 forming a lattice of circular islands. In this example, the resist will protect the circular islands, leaving a plurality of circular conductive islands after etching. Conversely, resist may be applied to the region outside of the circular islands, resulting in a conductive screen with circular apertures. It is to be understood that the modeling of FIGS. 2 and 3 are in reality a portion or segment of a longitudinal "strip" or section which may be part of an open latticework metallization pattern as shown in FIG. 1. It has been found that simplifying the lattice member to a strip results in a reasonably good approximation for calculating fields and temperature rise.

Figure 14:
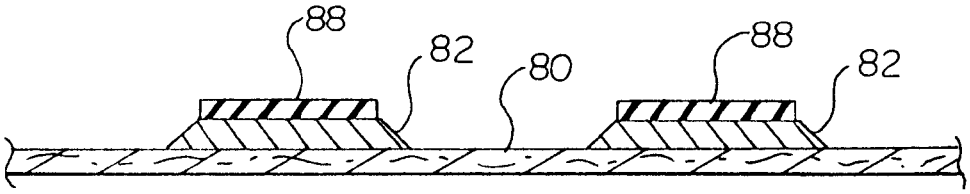
FIG. 14 is a side section view of a first form of etched pattern useful in the practice of the present invention.
Figure 15:
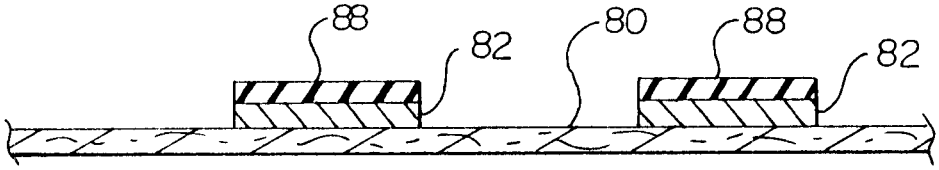
FIG. 15 is a side section view of a second form of etched pattern useful in the practice of the present invention.
Figure 16:
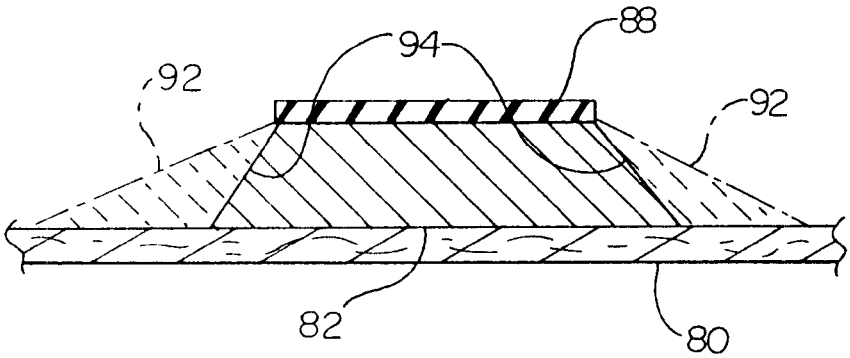
FIG. 16 is a side section detail view of a portion of FIG. 14.

The angle $\theta$ and the desired radius $r_c$ are achieved by regulating the etching conditions. It is to be understood that the "angle $\theta$" analysis applies to the sharpest corner in the metal. If an etching system is used that sprays the metal with etchant using jets, parameters that can be adjusted are the time that the metal is exposed and the pressure of the etchant jets, in addition to the potentcy (aggressiveness) of the etchant. The following. discussion assumes a constant potentcy of the etchant, but it is to be understood that changes in potency may also be used to achieve the aims of the present invention. To achieve small angles for $\theta$ and a small characteristic radius $r_c$ the laminate is preferably exposed to the chemical etchant at low pressure just long enough to form the pattern, as shown in FIG. 14. Leaving the laminate in the etching process for a longer time will tend to smooth out the sharp corners and result in an increased radius $r_c$. A higher jet pressure will result in an increased angle $\theta$. FIG. 15 illustrates a degree or duration of etching resulting in a $\theta$ of about 90°. An alternative etching process would be to immerse the metal into an etchant bath of liquid or vapor for a predetermined amount of time. In such a process, the immersion time can be used to control the result. Shorter times would give small values for $r_c$ and $\theta$ while longer times will result in larger values for both $r_c$ and $\theta$. In FIG. 15, all metal corners have an angle $\theta$ about 90°. FIG. 16 is an enlarged view of one island or conductive region showing a small radius $r_c$ and small angle $\theta$ in phantom lines 92 (corresponding to FIG. 14), and a larger radius $r_c$ and larger angle $\theta$ in solid lines 94 to illustrate the effect that extended etching has in obtaining an increase in the radius $r_c$ and angle $\theta$. It is to be understood that increasing the etching potentcy (i.e., the aggressiveness of the etchant in removing material) will generally increase the radius $r_c$.

It is to be understood that the main attributes which determine the temperature of the metal are the length of the edge available for heating and the surface area available to transfer heat away from the metal. The horizontal width of the metal pattern may come into play in that a larger width will increase the heat transfer from the metal pattern, therefor lowering the temperature. The steady state temperature of the metal is approximately proportional to the reciprocal of the width. It is believed preferably to use widths of about 0.1 cm to about 2 cm. The thickness of the metal will determine the rate and time it takes to reach steady state temperature. For practical purposes, thicknesses less than a fraction of a centimeter will result in a thermal transition time to steady state temperature of a fraction of a second, so thickness is not significant in this regard. The time scale is proportional to $h^2/D$, where h is the thickness and D is the thermal diffusivity of the metal, which is characteristically about 1 $cm^2$/sec. This assumes the thickness is much less than the width of the pattern used. If not, then the thickness will also play a role in heat transfer from the metal strips or pattern.

One food load example useful in the practice of the present invention is a mass or slurry of unpopped popcorn and oil contained in a paper bag which has some or all of its surface carrying a metal lattice 10. The package may also have a microwave susceptor carried thereon, as is well known in the art. As described above, one or more of the radius, corner angle and edge roughness may be controlled to avoid arcing and increase heating of the food load while the metal lattice may be used to shield the heated food load (such as popped popcorn) from overcooking and scorching. The pattern geometry will also affect the temperature since the energy input is proportional to the total edge width, while the energy conducted away is proportional to the surface area of the metal. Hence the shape, width, and number of metal strips or other patterns are also factors that affect heating of the food load.

The invention thus can be seen to include a method for controlling arcing of foil members used in food packaging for microwave heating where a conductive member is formed as a lamination layer on a non-conductive substrate of a food package wherein one or more geometric characteristics of an edge portion of the conductive member are controlled to respective predetermined values to limit the peak E field adjacent the edge portion resulting from exposure to microwave irradiation. The specific geometric characteristics controlled include one or more of a wedge angle formed at the edge portion of the conductive member, a radius located at the apex of the wedge angle which is formed by intersection of the two sides at the edge portion. Another specific geometry able to be controlled is the roughness formed at the edge portion of the conductive member to control the heating resulting from exposure to microwave irradiation. The invention includes a partially conductive food package for microwave heating including a non-conductive substrate and a conductive pattern located on the substrate, with the conductive pattern having an edge portion with a cross section including a wedge angle formed by adjacent sides of the edge portion where the wedge angle is controlled to a value greater than a predetermined value to prevent arcing at the conductive pattern when the food package is exposed to microwave irradiation. Alternatively or additionally, the radius of a corner where the two sides of the edge portion meet can be controlled to a value greater than a predetermined value to prevent arcing. The edge portion can have a characteristic roughness controlled to a level below a predetermined roughness level to limit the amount of heating of the conductive pattern due to microwave irradiation.

The invention is not to be taken as limited to all of the details thereof, as modifications and variations thereof may be made without departing from the spirit or scope of the invention. For example, and not by way of limitation, conventional and well-known forms of etching, may be used to carry out the practice of the present invention.

What is claimed is:

1. A method for controlling arcing of foil members used in a food package for microwave heating comprising the steps of:

a) forming a conductive member as a lamination layer on a non-conductive substrate of a food package intended for microwave heating; and b) controlling a geometric characteristic of a cross section of an edge portion of the conductive member to a predetermined value to limit the peak B-field adjacent the edge portion resulting from exposure of the package to microwave irradiation.

2. The method of claim 1 wherein the step of controlling further comprises controlling an angle formed at the edge portion of the conductive member.

3. The method of claim 1 wherein the step of controlling further comprises controlling a radius formed at the edge portion of the conductive member.

4. The method of claim 1 wherein the step of controlling further comprises controlling both an angle and a radius formed at the edge portion of the conductive member.

5. The method of claim 1 wherein the food package includes a food load in the package.

6. The method of claim 1 wherein the substrate is formed of a cellulosic material.

7. The method of claim 6 wherein the cellulosic material is selected from the group consisting of paper, paperboard and cardboard.

8. The method of claim 1 wherein the substrate is formed of polymer material.

9. The method of claim 8 wherein the polymer material is polyethylene terepthalate.

10. The method of claim 1 wherein the conductive member is formed of metal.

11. The method of claim 10 wherein the metal is selected from the group consisting of aluminum, steel, brass and a mixture thereof.

12. A method for avoiding arcing at a partially electrically conductive food package for microwave heating comprising the steps of:

a) forming a conductive pattern having at least one elongate region on a substrate of a food package intended for microwave heating; and b) controlling both a wedge angle and a corner radius of an edge portion of the elongate region of the conductive pattern to limit the peak E-field at the edge of the conductive pattern to a value less than a value at which a medium adjacent the edge will support the field without electrical breakdown in response to exposure of the package to microwave irradiation in a consumer oven.

13. The method of claim 12 wherein the medium adjacent the conductive pattern is air.

14. The method of claim 12 wherein the food package contains a food load inside the package.

15. A partially conductive food package for microwave heating comprising:

a) a non-conductive substrate; and b) a conductive pattern located on the non-conductive substrate, the conductive pattern having an edge portion, the edge portion having a cross section including a wedge angle formed by adjacent sides of the edge portion;

wherein the wedge angle is controlled to a value greater than a predetermined value to prevent arcing at the conductive pattern when the food package is exposed to microwave irradiation.

16. A partially conductive food package for microwave heating comprising:

a) a non-conductive substrate;

b) a conductive pattern located on the non-conductive substrate, the conductive pattern having an edge portion, the edge portion having a cross section including a pair of adjacent sides meeting at a corner having a radius wherein the radius is controlled to a value greater than a predetermined value to prevent arcing at the conductive pattern when the food package is exposed to microwave irradiation.

17. A partially conductive food package for microwave heating comprising:

a) a non-conductive substrate;

b) a conductive pattern located on the non-conductive substrate, the conductive pattern having a edge, the edge having a cross section including a wedge angle and radius at an apex of the wedge angle wherein the combination of the wedge angle and the radius is controlled within a predetermined range to prevent arcing at the conductive pattern when the food package is exposed to microwave irradiation.

18. A method of forming a foil member for a microwave food package to avoid arcing comprising the steps of:

a) forming a conductive layer on a non-conductive substrate of a food package intended for microwave heating;

b) etching a portion of the conductive layer away from the non-conductive substrate while controlling a wedge angle $\theta$ and an apex radius $r_c$ at the apex of the wedge angle of the conductive material formed as the etching removes the conductive layer; and c) stopping etching when a desired combination of wedge angle and apex radius are achieved.

19. The method of claim 18 wherein the step of etching is performed to achieve a combination of wedge angle and apex radius according to the equation $$E_{max}=E_0(0.584+0.329\ \theta)(2\pi r_c/\lambda)^{(\theta-\pi)/(2\pi-\theta)}$$

such that $E_{max}$ is less than a predetermined breakdown voltage for a medium adjacent the foil when the food package is placed in a microwave field of intensity $E_0$.

20. The method of claim 19 wherein the medium adjacent the foil is air.

21. The method of claim 19 wherein the microwave field intensity $E_0$ is a predetermined average field intensity characteristic of consumer microwave ovens.

22. The method of claim 21 wherein $E_0$ is about $3\times10^4$ volts/meter.

23. The method of claim 18 wherein the step of etching is performed by spraying the conductive layer with an etchant.

24. The method of claim 18 wherein the step of etching is performed by immersing the conductive layer in a bath of etchant.

25. The method of claim 18 wherein increasing the etching increases the apex radius.

26. The method of claim 18 wherein increasing the etching increases the wedge angle.

* * * * *